United States Patent [19]

Efremidi et al.

[11] 3,976,449

[45] Aug. 24, 1976

[54] INSTALLATION FOR ELECTROSTATIC PRECIPITATION

[76] Inventors: Anatoly Lazarevich Efremidi, ulitsa Atoneli, 18; Anton Lavrentievich Saralidze, ulitsa Sovetskaya, 87, both of Tbilisi, U.S.S.R.

[22] Filed: Oct. 7, 1975

[21] Appl. No.: 620,493

[52] U.S. Cl. ..... 55/139; 317/262 AE; 321/10

[51] Int. Cl.[2] ..... B03C 3/66

[58] Field of Search ..... 55/139; 317/262 AE; 321/10

[56] References Cited

UNITED STATES PATENTS

| | | | |
|---|---|---|---|
| 2,280,330 | 4/1942 | White | 55/139 |
| 2,841,239 | 7/1958 | Hall et al. | 55/105 |
| 2,860,723 | 11/1958 | Wintermute | 55/105 |

*Primary Examiner*—Bernard Nozick
*Attorney, Agent, or Firm*—Fleit & Jacobson

[57] ABSTRACT

Proposed is an installation for electrostatic precipitation comprising at least two electrode gaps, each of said gaps being formed by a receiving and a corona electrodes, and a high-voltage rectifying unit embodied on the basis of a transformer. The high-voltage winding of the transformer is provided with a gate circuit comprising two opposing gates, which gate circuit is connected in parallel to said high-voltage winding, the common point of said gates being electrically connected with the receiving electrodes. The high-voltage winding of the transformer is also connected via linear electric elements to the corona electrodes, a discharge circuit for each of the electrode gaps alternately forming via the high-voltage winding of the transformer and the other electrode gap.

2 Claims, 7 Drawing Figures

Figure 1:
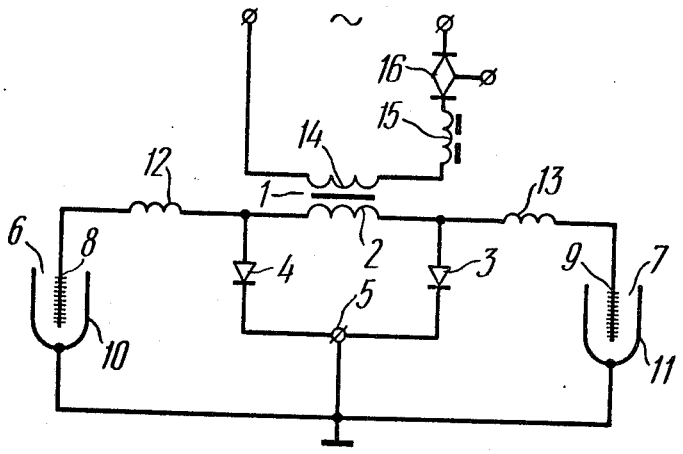

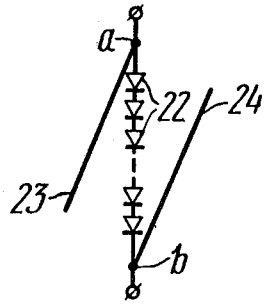
FIG. 3
FIG. 4a
FIG. 4b
FIG. 4c
FIG. 4d
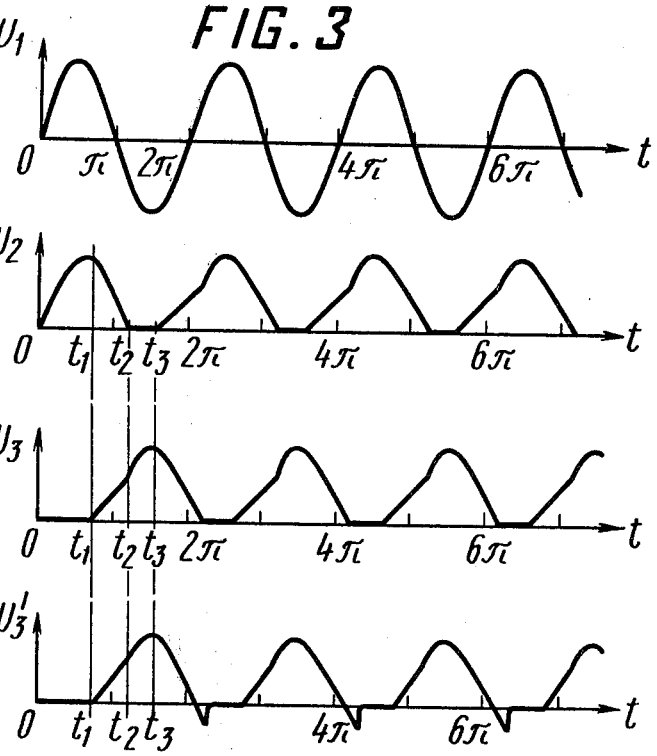

INSTALLATION FOR ELECTROSTATIC PRECIPITATION

The present invention relates to the art of electrostatic precipitation of dispersed particles in strong electric fields, and, more specifically, to installations for electrostatic precipitation used for trapping dust in the process of gas purification, for settling charged particles in the process of electrostatic painting, for spraying powdered materials and for other purposes.

In recent years, owing to more stringent rules and regulations pertaining to the protection of atmosphere air against pollution caused by industrial wastes and a wider use of low quality fuels in power generation, the fuels being characterised by high ash content and increased content of suspended particles having high electric resistivity, the problem of purification of waste gases become particularly urgent.

Precipitation of comparatively low-resistance dust, having a resistivity of up to $10^{10}$ ohm/cm is comparatively easy because of quick discharge of the layer of settled dust on receiving electrodes, whereas trapping of dust having electric resistivity of more than $10^{10}$ ohm/cm is at present a rather complicated engineering problem owing to difficulties experienced in discharging the layer of dust settled on electrodes. Known in the art is an installation for electrostatic precipitation used for electric purification of gas, said installation comprising at least two electrode gaps, each of said gaps being formed by a receiving and a corona electrodes, and a high-voltage rectifying unit, embodied on the basis of a transformer, whose high-voltage winding lead-outs are electrically connected by means of gates to the corona electrodes. Besides there is provided a circuit gate comprising two opposing gates, which circuit is connected in parallel to the lead-outs of the high-voltage winding, the common point of said gates being electrically connected to the receiving electrodes.

Since installations for electrostatic precepitation are characterised by a considerable electric capacity of the electrode gap, and since at the same time the equivalent active resistance of the electrode gap is also very high, owing to a non-linear current-voltage characteristic of a corona discharge in the electrode gap, the time of voltage drop in the electrode gap, or the time of discharge of capacity of said gap, is also very long.

Consequently, when installations of said type are supplied from power mains of commercial frequency, the electrode gap voltage cannot drop down to zero in the course of one period of supply voltage, and the capacity of the electrode gap cannot be discharged to other circuits of the installation due to the opposing gates being connected between the lead-out of the high-voltage winding of the transformer and the corona electrodes. Owing to the above, a discharge of the layer of dust precipitated on the electrodes cannot be ensured resulting in a break-down of the layer of the settled dust — "inversed corona" and in reduction of efficiency of the installation for electrostatic precipitation of high-resistance dusts.

It is the object of the invention to provide an installation for electrostatic precipitation ensuring a voltage drop in electrode gaps down to zero during each period of supply voltage, which feature would provide for a discharge of the layer of high-resistance dust settled on the electrodes, elimination of "inverse corona" and for increasing the efficiency of high-resistance dust precipitation.

This object is attained by providing an installation for electrostatic precipitation, comprising at least two electrode gaps, each of said gaps being formed by a receiving and a corona electrodes, and a high-voltage rectifying unit, embodied on the basis of a transformer, the high-voltage winding of which is electrically connected to the corona electrodes, a circuit gate comprising two opposing gates, which circuit gate in connected in parallel to said high-voltage winding, the common point of said gates being electrically connected to said receiving electrodes, according to the invention, the high-voltage winding of the transformer is connected via linear electric elements to the corona electrodes, providing thereby for the formation of a discharge circuit for each of the electrode gaps alternately via the high-voltage winding of the transformer and the other electrode gap.

To accelerate the discharge of the layer of high-resistance dust, in certain cases it is preferred to connect the common point of the gate circuit via an inductance coil to the receiving electrodes.

The proposed installation for electrostatic precipitation embodied according to the present invention, provides for voltage drop on the electrode gaps of said installation down to zero at each period of change of supply voltage, resulting in discharge of the layer of the settled dust, elimination of "inversed corona", increase of the efficiency of gas purification and reduction the consumption of electric energy required for precipitation. Besides, the proposed installation is characterised by simple design and can be embodied on the basis of presently existing installations without any substantial redesigning of said installations.

Figure 2:
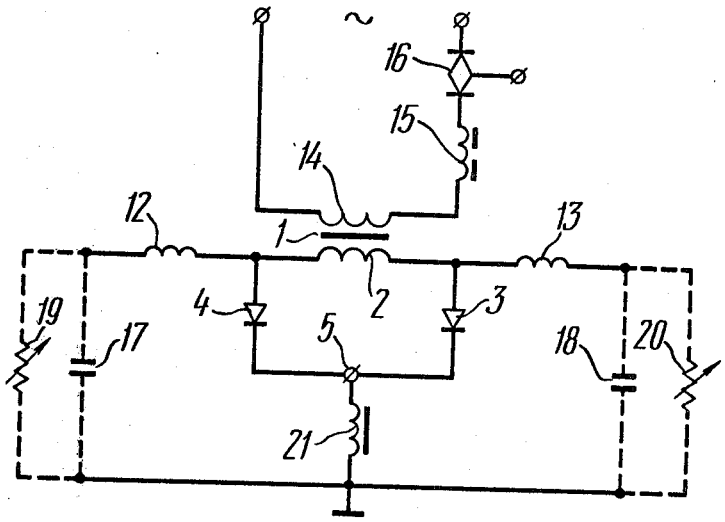

Hereinafter the present invention is explained with reference to an embodiment thereof for electrostatic precipitation of high-resistance dusts for gas purification with reference to the accompanying drawings, wherein, according to the invention:

FIG. 1 — key diagram of an installation for electrostatic precipitation;

FIG. 2 — equivalent circuit diagram of an installation for electrostatic precipitation provided with an inductance coil, said coil being connected between the common point of the gates and the receiving electrodes;

FIG. 3 — key circuit diagram of a gate used in an installation for electrostatic precipitation;

FIGS. 4*a*, *b*, *c*, *d* — oscillograms of voltages on the transformer and on the electrode gaps of an installation for electrostatic precipitation.

The installation for electrostatic precipitation shown in FIG. 1 comprises a single-phase step-up power transformer I provided with a gate circuit comprising two opposing gates 3 and 4, which circuit is connected in parallel to the high-voltage winding 2 of said transformer I.

The common point 5 of the gate circuit is earthed.

Interelectrode gaps 6 and 7, the space thereof containing gases, are formed with one of the corona electrodes 8 and 9 and with one of the receiving electrodes 10 and 11. Receiving electrodes 10 and 11 are connected to the common point 5 of the gates and earthed. Between the lead-outs of the high voltage winding 2 of the transformer I and the corona elements 8 and 9 there are connected linear elements 12 and 13, which in the described embodiment of the installation are high-frequency chokes. In certain cases said high-frequency chokes may be omitted, in this case the high-voltage winding 2 is connected to the corona electrodes 8 and 9 by means of wires.

A primary winding 14 of the high voltage transformer 1 is connected via a current-limiting inductance 15 and via a semiconductor operated gate 16 to the A.C. mains, said mains not being shown in the Figures.

The equivalent diagram of an installation for electrostatic precipitation shown in FIG. 2 differs from the circuit diagram in FIG. 1 in that in FIG. 2 the electrode gaps are shown in the form of concentrated electric capacitances 17 and 18 and non-linear active resistances 19 and 20, determined by the voltage-current characteristics of the electrode gaps. Besides, in the equivalent diagram of common point 5 of the circuit gate is connected to the receiving electrodes and to earth via an inductance coil 21, said coil being provided with a ferromagnetic core.

FIG. 3 shows an embodiment of a circuit diagram of gates 3 and 4 used in the installation for electrostatic precipitation. In this case semi-conductor silicon diodes 22 connected to form a series gate circuit are used as gates. Besides, each gate contains two flat metal screens 23 and 24, each of said screens being connected to ends *a* and *b* of the gate circuit, the distance from the screens 23 and 24, to the diode chain increasing the distance from the screens 23 and 24 to the diode gate circuit increases.

FIGS. 4*a, b, c, d* shows oscillograms of voltages across the transformer and across the electrode gaps of the installation for electrostatic precipitation, FIG. 4 showing an oscillogram $U_1(t)$ across the high-voltage winding of the transformer, said oscillogram repeating the voltage across the primary winding of the transformer, said voltage being practically sinusoidal when the operated gate 15 (FIG. 1) is fully conducting.

The oscillogram of voltage $U_2(t)$ across the first electrode gap 6 (FIG. 1), after said gap is put in operation at $t_0$ moment, is shown in FIG. 4*b*, wherein $t_1$ — is the moment when the voltage across the first electrode gap reaches its maximum value, $t_2$ — is the moment of complete discharge of capacity of the first electrode gap, $t_3$ — is the moment when the voltage across the second electrode gap 7 (FIG. 1) reaches its maximum value.

FIG. 4*c* shows the oscillogram of voltage $U_3(t)$ across the second electrode gap 7 (FIG. 1). FIG. 4*d* shows an oscillogram of voltage $U_3'$ (t) across the second electrode gap 7 (FIG. 1) provided the circuit comprises inductor 21 (FIG. 2).

The reference numerals used in FIGS. 4*c* and 4*d* are those used in FIG. 4*b*.

The proposed installation for electrostatic precipitation operates as follows. In the initial state the electrode gaps 6 and 7 (FIG. 1) are filled with waste dust-laden gases. When the installation is connected to an A.C. mains by means of the operated gate 16, for example at the moment of transition of voltage through zero (FIG. 4*a*), during one of the half-periods of change of the supply voltage of the transformer I, the capacity 17 (FIG. 2) of the electrode gap 6 (FIG. 1) is charged via the gate 3 up to a maximum value of the voltage at $t_i$ moment (FIG. 4*b*), after which the gate 3 (FIG. 2) is cut off and the capacity 17 is discharged to capacity 18 of the electrode gap 7 and to a respective resistance 19. The voltage across the electrode gap 6 by $t_2$ moment drops down to zero, whereas the voltage across the electrode gap 7 increases.

As the voltage across the electrode gap 6 or 7 (FIG. 1) increases the process of charging the particles of dust, contained in this gap and the process of precipitating said particles on the receiving electrodes 10 and 11 is started.

During the next half-period of change of the supply voltage, after the supply voltage drops down to zero, the capacity 17 (FIG. 2) is recharged up to the value of voltage at which the gate 4 is enabled, the current flowing through the gate 4 increases, and at the same time the capacity 18 of the electrode gap 7 is charged up to the maximum value of voltage at $t_1$ moment (FIG. 4*c*), after which the gate 4 (FIG. 2) is out off and the process of discharge of the capacity 18 of the electrode gap 7 to the capacity 17 of the electrode gap 6 and to the respective non-linear resistance 20 is started — time moment $t_3$ (FIG. 4*b*).

Before the $t_3$ moment the voltage across the electrode gap 6 is zero. The voltage drop down to zero across the electrode gap 6 and the availability of a period of time during which the value of said voltage is zero (from $t_2$ moment till $t_3$ moment) fascilitate the discharge of the layer of precipitated high-resistance dust.

Then the above-described process is periodically repeated and a half-period rectified voltage dropping down to zero is applied to each electrode gap, a discharge circuit being formed for each of said gaps alternately via the high-voltage winding 2 (FIG. 1) of the transformer I and via the other electrode gap.

The high-voltage chokes 12 and 13 are used for limiting the pulsed currents and overvoltages acting upon the transformer I at the time of arc-type discharges in the electrode gaps 6 and 7.

The inductance coil 15 is used for limiting the currents at arc break-downs and short circuits in the electrode gaps 6 and 7 and also for improving the shape of the supply voltage across the winding 14 of the transformer I when using the operated gate 16.

The high-resistance dust precipitating on the receiving electrodes 10 and 11 is periodically shaken off into a bunker (not shown in the Figures) and removed by conventional methods.

When the common point 5 (FIG. 2) of the gate circuit is connected to the receiving electrodes 10 and 11 (FIG. 1) via the inductance coil 21 (FIG. 2), the principle of operation of the installation for electrostatic precipitation corresponds to the above description.

This being the case, the capacity of each electrode gap 6 and 7 is recharged until the value of voltage equals that across the inductance coil 21 (FIG. 2).

The inductance coil 21 is connected to the circuit of rectified current at the output of the rectifier, and serves to ensure the above-mentioned jump of the inverse polarity voltage across the electrode gaps, and also provides for limiting the pulsed currents and overvoltages acting upon the rectifier during arc and spark-discharges in the electrode gaps.

The value of the inverse voltage pulses, shown in the oscillogram of FIG. 4*d* may change depending on the nature of the trapped dust by changing the inductivity of the inductance coil 21.

In certain cases, when it is not required to apply the inverse voltage pulses to the electrode gaps to accelerate the discharge of the layer of precipitated dust, the inductance coil may be omitted.

The coil 21 may be of a single or double wound type to provide for remagnetization of the core and for reducing the dimensions thereof.

A high-voltage gate shown in FIG. 3 is embodied as a gate circuit comprising silicon diodes 22 connected in series, the number of diodes being defined by the level of the rectified voltage, which gate circuit is screened with two flat metal screens 23 and 24, each of said screens being connected to the ends *a* and *b* of said gate circuit. Once a voltage with a steep wave front is applied to the gate, owing to the provided type of the system of screening, it will be uniformly distributed along the gate circuit of diodes 22, because each of said diodes will be provided with identical conditions, and the capacity of said diode versus both screens 23 and 24 will be fixed.

If one of the electrode gaps, 6 or 7 (FIG. 1), is rendered inoperative, the above-described conditions of power supply of the other, operative electrode gap can be ensured by replacing the faulty gap by a capacitor of equivalent capacity, connected between the earth and the output of the high-voltage winding 2 of the transformer 1.

The proposed principle can be used for making not only single-phase, but also multi-phase systems.

An installation for electrostatic precipitation can be supplied from 380/200 v 50–60 Hz mains. The voltage across the high-voltage winding 2 of the high-voltage transformer I is 60–80 kV (effective value). The type of the high-voltage gates 3 and 4 is chosen to suit the inverse voltage of 120–160 kV and up to 2 A current.

The high-frequency chokes 12 and 13 are of several tens millihenry inductance and of 200–300 kV pulse strength. The type of the inductance coil 21 to be used is chosen to suit the voltage of 40% of the rated voltage across the electrode gap at the inductance of several tens of henry.

The current-limiting inductance 15 connected from the power supply side is chosen to suit the current limiting of short-circuit currents the value of which is 3–5 times higher than that of the rated load currents. The type of the controlled silicon gate 16 is chosen depending on the rated current of the installation.

If the installation is used for electric gas purification, the electrode gaps 6 and 7 are electric filters, the capacity thereof usually being in the order of 40000–100000 picofarads and the current load thereof being in the order of 250–1600 mA.

What is claimed is:

1. An installation for electrostatic precipitation, comprising: at least two receiving electrodes; at least two corona electrodes; at least two electrode gaps, each of said gaps being formed by one of said receiving electrodes and by one of said corona electrodes; a high-voltage rectifying unit; a high-voltage transformer of said rectifying unit; a high-voltage winding of said transformer; two opposing gates, the other outputs of which are connected in parallel to said high-voltage winding; a common point of said gates, which point is electrically connected to said receiving electrodes; linear electric elements, each of said elements being cut in between one of the bushings of said high-voltage winding and one of said corona electrodes; said electrode gaps, a circuit being formed alternately for each of said gaps via said high-voltage winding of the transformer and said other electrode gap.

2. An installation for electrostatic precipitation as claimed in claim 1, wherein the common point of the gate circuit is connected via an inductance coil to said receiving electrodes.

* * * * *